US006911892B2

(12) United States Patent
Tanaka

(10) Patent No.: US 6,911,892 B2
(45) Date of Patent: Jun. 28, 2005

(54) ALLOY TYPE THERMAL FUSE AND FUSE ELEMENT THEREOF

(75) Inventor: Yoshiaki Tanaka, Osaka (JP)

(73) Assignee: Uchihashi Estec Co., Ltd., Osaka (JP)

( * ) Notice: Subject to any disclaimer, the term of this patent is extended or adjusted under 35 U.S.C. 154(b) by 0 days.

(21) Appl. No.: 10/910,012

(22) Filed: Aug. 3, 2004

(65) Prior Publication Data

US 2005/0007233 A1 Jan. 13, 2005

Related U.S. Application Data

(63) Continuation of application No. 10/379,323, filed on Mar. 4, 2003, now Pat. No. 6,819,215.

(30) Foreign Application Priority Data

Mar. 6, 2002 (JP) ..... P 2002-59861

(51) Int. Cl.[7] ..... H01H 85/06

(52) U.S. Cl. ..... 337/290; 337/296; 337/297; 337/160

(58) Field of Search ..... 337/290, 296, 337/295, 297, 159, 160, 416; 29/623; 420/562, 571, 572, 576, 577, 580, 589; 148/433, 400, 442

(56) References Cited

U.S. PATENT DOCUMENTS

| | | | | | |
|---|---|---|---|---|---|
| 2,703,352 | A | * | 3/1955 | Kozacka | 337/163 |
| 2,769,877 | A | * | 11/1956 | Sundt | 337/163 |
| 2,864,917 | A | * | 12/1958 | Sundt | 337/163 |
| 3,168,632 | A | * | 2/1965 | Baran et al. | 337/227 |
| 3,198,914 | A | * | 8/1965 | Baran et al. | 337/405 |
| 3,201,646 | A | | 8/1965 | Mansfield | |
| 3,386,063 | A | | 5/1968 | Mansfield | |
| 3,836,883 | A | | 9/1974 | Takayasu | |
| 3,940,728 | A | | 2/1976 | Komatsu et al. | |
| 4,085,396 | A | | 4/1978 | Augis et al. | |
| 4,198,617 | A | | 4/1980 | Hara | |
| 4,292,617 | A | | 9/1981 | McVey | |
| 4,622,534 | A | | 11/1986 | Bowman | |
| 4,806,309 | A | * | 2/1989 | Tulman | 420/562 |
| 5,019,457 | A | * | 5/1991 | Nishio | 428/606 |
| 5,130,689 | A | * | 7/1992 | Raykhtsaum et al. | 337/296 |
| 5,139,883 | A | * | 8/1992 | Raykhtsaum et al. | 428/573 |
| 5,252,942 | A | | 10/1993 | Gurevich | |
| 5,631,621 | A | | 5/1997 | Nakajima | |
| 5,712,610 | A | | 1/1998 | Takeichi et al. | |
| 5,898,357 | A | | 4/1999 | Endo et al. | |
| 5,982,268 | A | | 11/1999 | Kawanishi | |
| 6,064,293 | A | | 5/2000 | Jungst et al. | |
| 6,222,438 | B1 | | 4/2001 | Horibe et al. | |
| 6,556,122 | B2 | * | 4/2003 | Izaki et al. | 337/405 |
| 2003/0169144 | A1 | | 9/2003 | Tanaka | |
| 2003/0170140 | A1 | | 9/2003 | Tanaka | |

FOREIGN PATENT DOCUMENTS

| | | | | | |
|---|---|---|---|---|---|
| GB | 2148626 | A | * | 5/1985 | H01H/85/06 |
| JP | 63-262438 | A | | 10/1988 | |
| JP | 04012428 | A | | 1/1992 | |
| JP | 6-325670 | A | | 11/1994 | |
| JP | 7-66730 | B2 | | 7/1995 | |
| JP | 3226213 | B2 | | 8/2001 | |
| JP | 2001-266273 | A | | 9/2001 | |
| JP | 2001-266724 | A | | 9/2001 | |
| JP | 2001-291459 | A | | 10/2001 | |
| JP | 2001-325867 | A | | 11/2001 | |

* cited by examiner

*Primary Examiner*—Anatoly Vortman
(74) *Attorney, Agent, or Firm*—Akin Gump Strauss Hauer & Feld, LLP

(57) ABSTRACT

The invention provides a thermal fuse and a fuse element of the low-melting fusible alloy type in which the fuse element has an alloy composition of 37 to 43% In, 10 to 18% Sn, and the balance Bi. As a result, the operating temperature is in the range of 65 to 75° C., requests for environment conservation can be satisfied, the diameter of the fuse element can be made very thin or reduced to about 300 $\mu$m$\phi$, self-heating can be suppressed, and the thermal stability can be satisfactorily guaranteed.

6 Claims, 3 Drawing Sheets

ALLOY TYPE THERMAL FUSE AND FUSE ELEMENT THEREOF

CROSS-REFERENCE TO RELATED APPLICATIONS

This application is a continuation of U.S. patent application Ser. No. 10/379,323, filed Mar. 4, 2003, now U.S. Pat. No. 6,819,215 which was published on Sep. 11, 2003, under U.S. Publication No. 2003-0169143-A1, and the disclosure of which is incorporated herein by reference.

BACKGROUND OF THE INVENTION

The present invention relates to an alloy type thermal fuse, more particularly to improvement in an alloy type thermal fuse of an operating temperature of 65 to 75° C., and also to a fuse element which constitutes such a fuse, and which is made of a low-melting fusible alloy.

In a conventional alloy type thermal fuse, a low-melting fusible alloy piece to which a flux is applied is used as a fuse element. When an electric apparatus on which such a fuse is mounted abnormally generates heat, therefore, a phenomenon occurs in which the low-melting fusible alloy piece is liquefied by the generated heat, the molten metal is spheroidized by the surface tension under the coexistence with the flux that has already melted, and the alloy piece is finally broken as a result of advancement of the spheroidization, whereby the power supply to the apparatus is interrupted.

The first requirement which is imposed on such a low-melting fusible alloy is that the solid-liquid coexisting region between the solidus and liquidus lines is narrow.

In an alloy, usually, a solid-liquid coexisting region exists between the solidus and liquidus lines. In this region, solid-phase particles are dispersed in a liquid phase, so that the region has also the property similar to that of a liquid phase, and therefore the above-mentioned breakage due to spheroidization may occur. As a result, there is the possibility that a low-melting fusible alloy piece is spheroidized and broken in a temperature range (indicated by $\Delta T$) which is lower than the liquidus temperature (indicated by T), and which belongs to the solid-liquid coexisting region. Therefore, a thermal fuse in which such a low-melting fusible alloy piece is used must be handled as a fuse which operates at a fuse element temperature in a range of $(T-\Delta T)$ to T. As $\Delta T$ is smaller, or as the solid-liquid coexisting region is narrower, the operating temperature of a thermal fuse is less dispersed, so that a thermal fuse can operate at a predetermined temperature in a correspondingly strict manner. Therefore, an alloy which is to be used as a fuse element of a thermal fuse is requested to have a narrow solid-liquid coexisting region.

The second requirement which is imposed on such a low-melting fusible alloy is that the electrical resistance is low. When the temperature rise by normal heat generation due to the resistance of the low-melting fusible alloy piece is indicated by $\Delta T'$, the operating temperature is substantially lower by $\Delta T'$ than that in the case where such a temperature rise does not occur. Namely, as $\Delta T'$ is larger, the operation error is substantially larger. Therefore, an alloy which is to be used as a fuse element of a thermal fuse is requested to have a low specific resistance.

Conventionally, as a fuse element of an alloy type thermal fuse of an operating temperature of 65 to 75° C., known is a Bi—Pb—Sn—Cd alloy (50% Bi, 26.7% Pb, 13.3% Sn, and 10% Cd (% means a weight percent (the same is applicable in the following description))) which is eutectic at 70° C. However, the alloy is not suitable to environment conservation which is a recent global request, because, among Pb, Cd, Hg, and Tl which are seemed to be harmful to the ecological system, Pb and Cd are contained in the alloy.

In order that the size of an alloy type thermal fuse is reduced in accordance with the recent tendency that electric or electronic apparatuses are further miniaturized, a fuse element must be made very thin (about 300 $\mu$m). However, the alloy which contains a large amount of Bi is so fragile that a process of drawing the alloy into such a very thin wire is hardly performed. In such a very thin fuse element, moreover, the relatively high specific resistance of the alloy composition cooperates with the thinness to extremely raise the resistance, with the result that an operation failure due to self-heating of the fuse element inevitably occurs.

Also an In—Bi alloy (66.3% In, and 33.7% Bi) which is eutectic at 72° C. is known. In the alloy, a solid phase transformation occurs at a temperature between 53° C. and 56° C. Because of relative relationships between the temperature and the operating temperature of 65 to 75° C., the temperature coincides with a temperature to which a fuse element is exposed during a normal operation of an apparatus. Therefore, strain due to a solid phase transformation is produced in the fuse element. As a result, the resistance of the fuse element is raised, and there arises the possibility that an operation failure due to self-heating of the fuse element occurs.

To comply with this, the inventor has proposed that an alloy composition of 25 to 35% Bi, 2.5 to 10% Sn, and the balance In is used as a fuse element of an alloy type thermal fuse in which the operating temperature is in the range of 65 to 75° C., no toxic metal is contained, the diameter of the fuse element can be reduced to about 300 $\mu$m$\phi$, and self-heating can be suppressed to enable the fuse element to normally operate (Japanese Patent Application Laying-Open No. 2001-291459).

In the alloy type thermal fuse, because of In and Bi of the above compound ratios, the melting point is provisionally set to the vicinity of 70° C. and adequate ductility required for drawing into a thin wire is obtained, and, because of the blending of Sn, the range of the solidus and liquidus temperatures is finally set to 65 to 75° C. and the specific resistance is set to be low. When the lower limit of the compound ratio of Sn is smaller than 2.5%, the amount of Sn is so insufficient that the above-mentioned solid phase transformation cannot be effectively prevented from occurring. When the upper limit of the compound ratio of Sn is larger than 10%, an In—Bi—Sn eutectic structure (58% In, 29% Bi, and 13% Sn) of a melting point of 62° C. appears, and the range of the solidus and liquidus temperatures cannot be set to be between 65° C. and 75° C. In this composition, since the total amount of In and Sn which have a relatively lower specific resistance is larger than the amount of Bi of a higher specific resistance, the whole specific resistance can be sufficiently lowered. Even in the case of a very thin wire of 300 $\mu$m$\phi$, a low resistance of a fuse element can be easily attained (25 to 35 $\mu\Omega\cdot$cm), a solid phase transformation does not occur in a lower temperature side of an operating temperature of 65 to 75° C., and also a resistance change due to a solid phase transformation of a fuse element at a temperature during a normal operation of an apparatus with respect to the operating temperature of 65 to 75° C. can be eliminated. Therefore, the operating temperature of the thermal fuse can be set to be within a range of ±5° C. with respect to 70° C.

In the alloy composition of the fuse element, In is 72.5 to 55% or occupies the majority of the composition. Since In is expensive, the production cost of such a fuse element is inevitably increased.

Such a thermal fuse is repeatedly heated and cooled by heat cycles of an apparatus. During the heat cycles, therefore, thermal stress of $\alpha \cdot \Delta t \cdot E$ where $\alpha$ is the coefficient of thermal expansion of the fuse element, $\Delta t$ is the temperature rise, and E is the Young's modulus is generated within the elastic limit, and compression strain of $\alpha \cdot \Delta t$ is imposed. In the above-mentioned alloy composition (25 to 35% Bi, 2.5 to 10% Sn, and the balance In), because of the large content of In (55 to 72.5%), the elastic limit is so small that a large slip is caused in the interface between different phases in the alloy structure by strain which is smaller than compression strain of $\alpha \cdot \Delta t$. When the strain is repeated, the sectional area and the length of the fuse element are changed, and the resistance of the fuse element itself becomes unstable. In other words, the thermal stability cannot be guaranteed.

BRIEF SUMMARY OF THE INVENTION

It is an object of the invention to provide an alloy type thermal fuse in which an alloy composition of In—Sn—Bi is used as a fuse element, the operating temperature is relatively low or in the range of about 65 to 75° C., requests for environment conservation can be satisfied, the diameter of the fuse element can be made very thin or reduced to about 300 $\mu$m$\phi$, self-heating can be sufficiently suppressed, and the thermal stability can be satisfactorily guaranteed.

In one embodiment of the present invention, the alloy type thermal fuse is a thermal fuse in which a low-melting fusible alloy is used as a fuse element, wherein the low-melting fusible alloy has an alloy composition of 37 to 43% In, 10 to 18% Sn, and balance Bi.

In another preferred embodiment of the present invention, the alloy type thermal fuse is a thermal fuse in which a low-melting fusible alloy is used as a fuse element, wherein the low-melting fusible alloy has an alloy composition in which a total of 0.01 to 3.5 weight parts of at least one selected from the group consisting of Ag, Cu, and Ni is added to 100 weight parts of a composition of 37 to 43% In, 10 to 18% Sn, and balance Bi.

In the above fuses, the alloy compositions are allowed to contain inevitable impurities which are produced in productions of metals of raw materials and also in melting and stirring of the raw materials.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
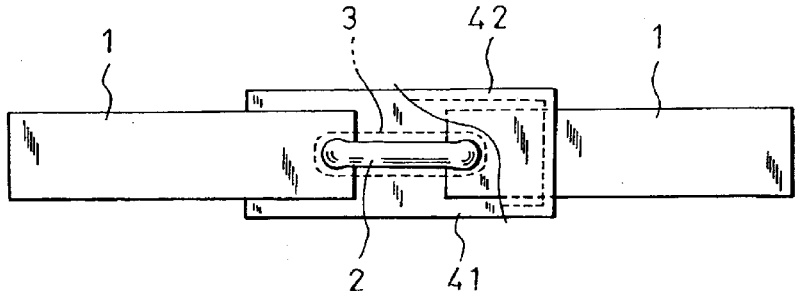
FIG. 1 is a view showing an example of the allow type thermal fuse of the invention.

In the alloy type thermal fuse of the invention, a circular wire having an outer diameter of 200 to 600 $\mu$m$\phi$, preferably, 250 to 350 $\mu$m$\phi$, or a flat wire having the same sectional area as that of the circular wire may be used as a fuse element.

The fuse element is made of an alloy of 37 to 43% In, 10 to 18% Sn, and the balance Bi, preferably, 39 to 42% In, 11 to 16% Sn, and the balance Bi, the reference composition being 40% In, 14% Sn, and 46% Bi. The liquidus temperature is 72° C., and the width of the solid-liquid coexisting region is 3° C.

In the thermal fuse of the invention, the fuse element is configured as follows:

(1) In—Sn—Bi containing no metal harmful to environment conservation is used;

(2) the compound ratio of In is reduced to 50% or less in order to guarantee the thermal stability against the above-mentioned heat cycle;

(3) the fuse element has a melting point by which the operating temperature can be set to 65 to 75° C., and the width $\Delta T$ of the solid-liquid coexisting region is suppressed to about 4° C. at the maximum in order to sufficiently reduce dispersion of the above-mentioned operating temperature range;

(4) drawing into a very thin wire of about 300 $\mu$m$\phi$ is enabled; and (5) the fuse element has an alloy composition of 37 to 43% In, 10 to 18% Sn, and the balance Bi, in order to sufficiently lower the resistance and suppress an operation error due to Joule's heat.

In the invention, In is controlled to a weight percent in the range of 37 to 43%, and Sn and Bi are mixed at a weight percent in the above-mentioned range, whereby the melting point can be set to a temperature at which an operating temperature of 65 to 75° C. is satisfied, without producing a solid phase transformation point at a low temperature, and the width of the solid-liquid coexisting region can be suppressed to 4° C. or smaller. When the amount of In is smaller than 37%, a Bi—In—Sn eutectic structure (57.5% Bi, 25.2% In, and 17.3% Sn) of a melting point of 81° C. appears, and, when the amount of In is larger than 43%, a Bi—In—Sn eutectic structure (51% In, 32.5% Bi, and 16.5% Sn) of a melting point of 62° C. appears, with the result that the desired operating temperature cannot be obtained and the width of the solid-liquid coexisting region cannot be suppressed to 4° C. or smaller.

In the invention, the amount of Sn is set to 10 to 18% because of the reasons that the melting point is set to the vicinity of 70° C. by controlling the amount of Bi, and that the ductility is enhanced so that an alloy formed by: In which is low in strength and very high in ductility; and Bi which is high in strength and very high in brittleness can be subjected to a process of drawing the alloy into a very thin wire of about 300 $\mu$m$\phi$. When the amount of Sn is smaller than 10%, the operating temperature cannot be set to 65 to 75° C., and the ductility enhancement cannot be satisfactorily attained so that the thin wire process is hardly performed, and, when the amount of Sn is larger than 18%, the strength is lowered and the ductility is made excessive by the reduced amount of Bi, and the resistance against process strain is extremely lowered so that the thin wire process is hardly performed.

In the other preferred embodiment, 0.01 to 3.5 weight parts of at least one of Ag, Cu, and Ni is added because of the reasons such as: that the specific resistance of the alloy is further lowered so that an operation error due to Joule's heat is suppressed more strictly; that the width ΔT of the solid-liquid coexisting region is further narrowed without substantially changing the operating temperature of 65 to 75° C. so that dispersion of the operating temperature is suppressed more strictly; and that the strength and the ductility required for the thin wire process are further enhanced so that the workability is further improved. The addition amount is set to 0.01 to 3.5 weight parts because of the following reason. When the amount is smaller than 0.01 weight parts, the above-mentioned effects cannot be satisfactorily attained, and, when the amount is larger than 3.5 weight parts, the melting point is varied and the operating temperature cannot be set to 65 to 75° C.

The fuse element of the thermal fuse of the invention can be produced by drawing a base material of an alloy, and used with remaining to have a circular shape or with being further subjected to a compression process to be flattened.

FIG. 1 shows a tape-like alloy type thermal fuse according to the invention. In the fuse, strip lead conductors 1 having a thickness of 100 to 200 μm is fixed by an adhesive agent or fusion bonding to a plastic base film 41 having a thickness of 100 to 300 μm. A fuse element 2 having a diameter of 250 to 500 μmϕ is connected between the strip lead conductors. A flux 3 is applied to the fuse element 2. The flux-applied fuse element is sealed by means of fixation of a plastic cover film 42 having a thickness of 100 to 300 μm by an adhesive agent or fusion bonding.

The alloy type thermal fuse of the invention may be realized in the form of a fuse of the case type, the substrate type, or the resin dipping type.

Figure 2:
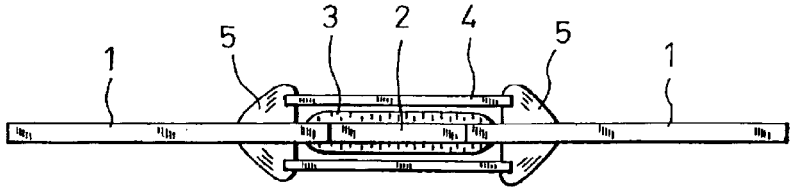
FIG. 2 is a view showing another example of the allow type thermal fuse of the invention.

FIG. 2 shows a fuse of the cylindrical case type. A fuse element 2 is connected between a pair of lead wires 1, and a flux 3 is applied onto the fuse element 2. The flux-applied fuse element is passed through an insulating tube 4 which is excellent in heat resistance and thermal conductivity, for example, a ceramic tube. Gaps between the ends of the insulating tube 4 and the lead wires 1 are sealingly closed by a cold-setting adhesive agent 5 such as an epoxy resin.

Figure 3:
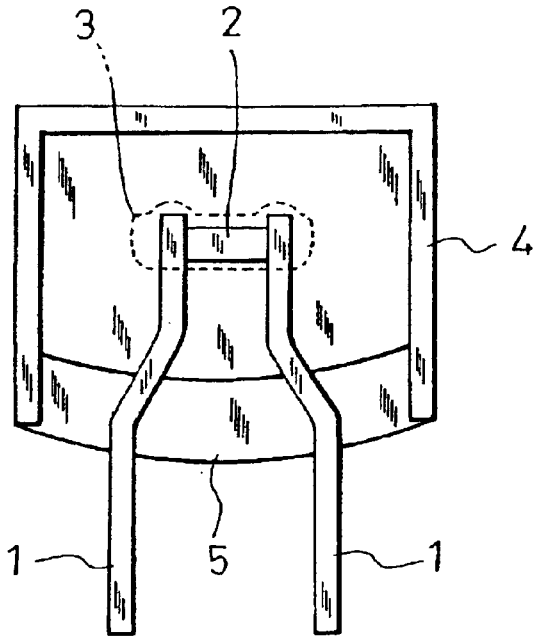
FIG. 3 is a view showing a further example of the alloy type thermal fuse of the invention.

FIG. 3 shows a fuse of the radial case type. A fuse element 2 is bonded between tip ends of parallel lead conductors 1 by welding, and a flux 3 is applied to the fuse element 2. The flux-applied fuse element is enclosed by an insulating case 4 in which one end is opened, for example, a ceramic case. The opening of the insulating case 4 is sealingly closed by a sealing agent 5 such as an epoxy resin.

Figure 4:
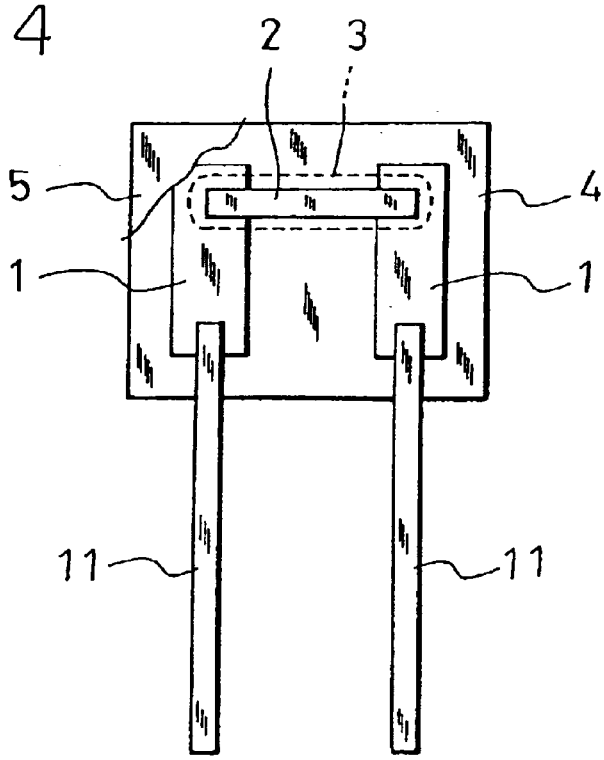
FIG. 4 is a view showing a still further example of the alloy type thermal fuse of the invention.

FIG. 4 shows a fuse of the substrate type. A pair of film electrodes 1 are formed on an insulating substrate 4 such as a ceramic substrate by printing of conductive paste (for example, silver paste). Lead conductors 11 are connected respectively to the electrodes 1 by welding or the like. A fuse element 2 is bonded between the electrodes 1 by welding, and a flux 3 is applied to the fuse element 2. The flux-applied fuse element is covered by a sealing agent 5 such as an epoxy resin.

Figure 5:
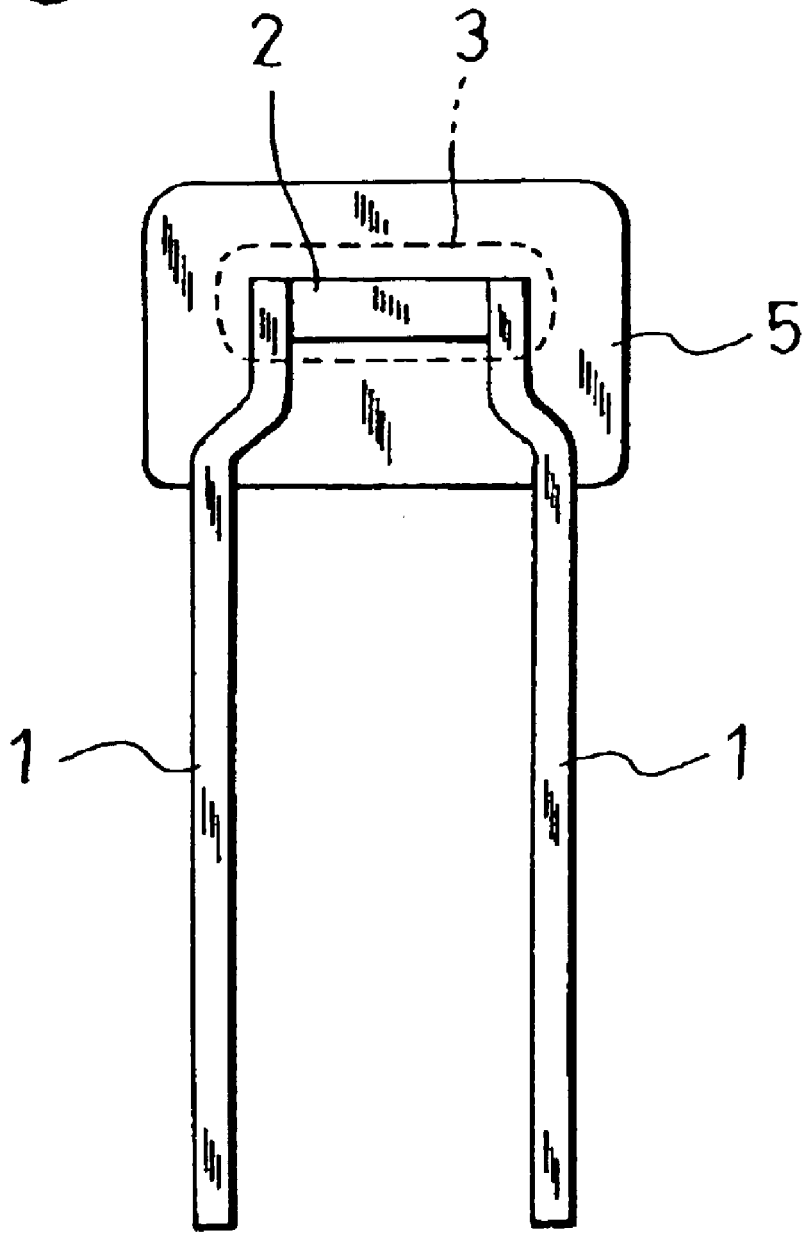
FIG. 5 is a view showing a still further example of the alloy type thermal fuse of the invention.

FIG. 5 shows a fuse of the radial resin dipping type. A fuse element 2 is bonded between tip ends of parallel lead conductors 1 by welding, and a flux 3 is applied to the fuse element 2. The flux-applied fuse element is dipped into a resin solution to seal the element by an insulative sealing agent 5 such as an epoxy resin.

The invention may be realized in the form of a fuse having an electric heating element, such as a substrate type fuse having a resistor in which, for example, a resistor (film resistor) is additionally disposed on an insulating substrate of an alloy type thermal fuse of the substrate type, and, when an apparatus is in an abnormal state, the resistor is energized to generate heat so that a low-melting fusible alloy piece is blown out by the generated heat.

As the flux, a flux having a melting point which is lower than that of the fuse element is generally used. For example, useful is a flux containing 90 to 60 weight parts of rosin, 10 to 40 weight parts of stearic acid, and 0 to 3 weight parts of an activating agent. In this case, as the rosin, a natural rosin, a modified rosin (for example, a hydrogenated rosin, an inhomogeneous rosin, or a polymerized rosin), or a purified rosin thereof can be used. As the activating agent, hydrochloride of diethylamine, hydrobromide of diethylamine, or the like can be used.

Now, embodiments of the present invention will be described in greater detail by way of example, wherein 50 specimens of the substrate type were used, each of the specimens was immersed into an oil bath in which the temperature was raised at a rate of 1° C./min., while supplying a current of 0.1 A to the specimen, and the temperature of the oil when the current supply was interrupted by blowing-out was measured.

With respect to the influence of self-heating, 50 specimens were used, and judgment was made while supplying a usual rated current (1 to 2 A) to each specimen.

With respect to the change in resistance of a fuse element caused by heat cycles, 50 specimens were used, and judgment was made by measuring a resistance change after a test of 500 heat cycles in each of which specimens were heated to 50° C. for 30 minutes and cooled to −40° C. for 30 minutes.

EXAMPLE (1)

A base material of an alloy composition of 40% In, 14% Sn, and 46% Bi was drawn into a wire of 300 μmϕ in diameter. The draw-down ratio per dice was 6.5%, and the drawing speed was 45 m/min. In the wire, no breakage occurred. The specific resistance of the wire was measured. As a result, the specific resistance was 48 μΩ·cm. The wire was cut into pieces of 4 mm, and small substrate type thermal fuses were produced with using the pieces as fuse elements. A composition of 80 weight parts of rosin, 20 weight parts of stearic acid, and 1 weight part of hydrobromide of diethylamine was used as a flux. A cold-setting epoxy resin was used as a covering member.

The operating temperatures of the resulting specimens were measured. The resulting operating temperatures were within a range of 72° C.±2° C. It was confirmed that, under the usual rated current, no influence of self-heating is made. Furthermore, a change in resistance of the fuse element which was caused by the heat cycles, and which may become a serious problem was not observed. It was confirmed that, in a range of 37 to 43% In, 10 to 18% Sn, and the balance Bi, the thin wire drawability, the low specific resistance, and the thermal stability which have been described above can be sufficiently guaranteed, and the operating temperature can be set to be within a range of 70° C.±5° C.

EXAMPLE (2)

A base material of an alloy composition of 38.6% In, 13.5% Sn, 44.5% Bi, and 3.4% Ag was drawn into a wire of 300 μmϕ in diameter. The draw-down ratio per dice was 6.5%, and the drawing speed was 45 m/min. In the wire, no breakage occurred. The specific resistance of the wire was measured. As a result, the specific resistance was 41 μΩ·cm.

The wire was cut into pieces of 4 mm, and substrate type thermal fuses were produced with using the pieces as fuse elements in the same manner as Example (1). The operating temperatures of the resulting specimens were measured. The resulting operating temperatures were within a range of 71° C.±1° C. It was confirmed that, under the usual rated current, no influence of self-heating is made.

Furthermore, a change in resistance of the fuse element which was caused by the heat cycles, and which may become a serious problem was not observed. It was confirmed that, in a range of 100 weight parts of a composition of 37 to 43% In, 10 to 18% Sn, and the balance Bi, and 0.01 to 3.5 weight parts of Ag, the thin wire drawability, the low specific resistance, and the thermal stability which have been described above can be sufficiently guaranteed, and the operating temperature can be set to be within a range of 70° C.±4° C.

EXAMPLE (3)

A base material of an alloy composition of 39.7% In, 13.9% Sn, 45.7% Bi, and 0.7% Cu was drawn into a wire of 300 μmϕ in diameter. The draw-down ratio per dice was 6.5%, and the drawing speed was 45 m/min. In the wire, no breakage occurred. The specific resistance of the wire was measured. As a result, the specific resistance was 42 μΩ·cm.

The wire was cut into pieces of 4 mm, and substrate type thermal fuses were produced with using the pieces as fuse elements in the same manner as Example (1). The operating temperatures of the resulting specimens were measured. The resulting operating temperatures were within a range of 71° C.±1° C. It was confirmed that, under the usual rated current, no influence of self-heating is made.

Furthermore, a change in resistance of the fuse element which was caused by the heat cycles, and which may become a serious problem was not observed. It was confirmed that, in a range of 100 weight parts of a composition of 37 to 43% In, 10 to 18% Sn, and the balance Bi, and 0.01 to 3.5 weight parts of Cu, the thin wire drawability, the low specific resistance, and the thermal stability which have been described above can be sufficiently guaranteed, and the operating temperature can be set to be within a range of 70° C.±4° C.

EXAMPLE (4)

A base material of an alloy composition of 39.7% In, 13.9% Sn, 45.7% Bi, and 0.7% Ni was drawn into a wire of 300 μmϕ in diameter. The draw-down ratio per dice was 6.5%, and the drawing speed was 45 m/min. In the wire, no breakage occurred. The specific resistance of the wire was measured. As a result, the specific resistance was 47 μΩ·cm. The wire was cut into pieces of 4 mm, and substrate type thermal fuses were produced with using the pieces as fuse elements in the same manner as Example (1). The operating temperatures of the resulting specimens were measured. The resulting operating temperatures were within a range of 71° C.±1° C.

It was confirmed that, under the usual rated current, no influence of self-heating is made.

Furthermore, a change in resistance of the fuse element which was caused by the heat cycles, and which may become a serious problem was not observed. It was confirmed that, in a range of 100 weight parts of a composition of 37 to 43% In, 10 to 18% Sn, and the balance Bi, and 0.01 to 3.5 weight parts of Ni, the thin wire drawability, the low specific resistance, and the thermal stability which have been described above can be sufficiently guaranteed, and the operating temperature can be set to be within a range of 71° C.±4° C.

EXAMPLE (5)

A base material of an alloy composition of 38.6% In, 13.5% Sn, 44.5% Bi, 2.7% Ag, and 0.7% Cu was drawn into a wire of 300 μmϕ in diameter. The draw-down ratio per dice was 6.5%, and the drawing speed was 45 m/min. In the wire, no breakage occurred. The specific resistance of the wire was measured. As a result, the specific resistance was 38 μΩ·cm.

The wire was cut into pieces of 4 mm, and substrate type thermal fuses were produced with using the pieces as fuse elements in the same manner as Example (1).

The operating temperatures of the resulting specimens were measured. The resulting operating temperatures were within a range of 70° C.±1° C. It was confirmed that, under the usual rated current, no influence of self-heating is made. Furthermore, a change in resistance of the fuse element which was caused by the heat cycles, and which may become a serious problem was not observed.

It was confirmed that, in a range of 100 weight parts of a composition of 37 to 43% In, 10 to 18% Sn, and the balance Bi, and 0.01 to 3.5 weight parts of a total of Ag and Cu, the thin wire drawability, the low specific resistance, and the thermal stability which have been described above can be sufficiently guaranteed, and the operating temperature can be set to be within a range of 71° C.±4° C.

COMPARATIVE EXAMPLE (1)

In the same manner as Examples, wire drawing into a wire of 300 μmϕ in diameter was attempted with using a base material of an alloy composition of 50% Bi, 26.7% Pb, 13.3% Sn, and 10% Cd. However, wire breakage frequently occurred. Therefore, the draw-down ratio per dice was reduced to 5.0%, and the drawing speed was lowered to 20 m/min. Under these conditions of reduced process strain, wire drawing was attempted. However, wire breakage frequently occurred, and it was impossible to perform drawing.

Since a thin wire process by drawing is substantially impossible as described above, a thin wire of 300 μmϕ in diameter was obtained by the rotary drum spinning method. The specific resistance of the thin wire was measured. As a result, the specific resistance was 61 μΩ·cm.

The thin wire was cut into pieces of 4 mm, and substrate type thermal fuses were produced with using the pieces as fuse elements in the same manner as Example (1). The operating temperatures of the resulting specimens were measured. As a result, it was confirmed that many specimens did not operate even when the temperature was largely higher than the melting point (70° C.).

The reason of the above is seemed as follows. Because of the rotary drum spinning method, a thick sheath of an oxide film is formed on the surface of a fuse element, and, even when the alloy inside the sheath melts, the sheath does not melt and hence the fuse element is not broken.

COMPARATIVE EXAMPLE (2)

A base material of an alloy composition of 66.3% In and 33.7% Bi was drawn into a wire of 300 μmϕ in diameter. The draw-down ratio per dice was 6.5%, and the drawing speed was 45 m/min. In the wire, no breakage occurred. The specific resistance of the wire was measured. As a result, the specific resistance was 37 μΩ·cm.

The wire was cut into pieces of 4 mm, and substrate type thermal fuses were produced with using the pieces as fuse elements in the same manner as Example (1). The operating temperatures of the resulting specimens were measured in the same manner as Examples. As a result, there were a wide variety of operating temperatures ranging from about 60° C. to about 74° C. Namely, it was observed that the operating temperatures were remarkably dispersed. The operation in the vicinity of 74° C. is based on the normal fusion, and that in the vicinity of 60° C. is seemed to be caused by a solid phase transformation.

COMPARATIVE EXAMPLE (3)

A base material of an alloy composition of 63.5% In, 3.8% Sn, and 32.7% Bi was drawn into a wire of 300 $\mu$mϕ in diameter. The draw-down ratio per dice was 6.5%, and the drawing speed was 45 m/min. In the wire, no breakage occurred. The specific resistance of the wire was measured. As a result, the specific resistance was 32 $\mu\Omega\cdot$cm.

The wire was cut into pieces of 4 mm, and substrate type thermal fuses were produced with using the pieces as fuse elements in the same manner as Example (1). The operating temperatures of the resulting specimens were measured. The resulting operating temperatures were within a range of 71° C.±1° C. It was confirmed that, under the usual rated current, no influence of self-heating is made. After a heat resistance test of 500 heat cycles, however, a large change in resistance occurred in some of the specimens. Such specimens were disassembled, and the fuse elements were observed. As a result, it was confirmed that the sectional areas of the fuse elements are partly reduced, and the lengths of the elements are shortened. The reason of this is seemed as follows. Since such a fuse element contains a large amount of In, the elastic limit is small. Therefore, the fuse element is caused to yield by thermal stress, and a slip occurs in the alloy structure. As a result of repetition of such a slip, the sectional area and the length of the fuse element are changed, so that the resistance of the element itself is varied.

The advantages of the present invention are as follows:

It is possible to provide an alloy type thermal fuse which uses a very thin fuse element of a diameter on the order of 300 $\mu$mϕ obtained by an easy process of drawing the base material of a Bi—In—Sn low-melting fusible alloy that is harmless to the ecological system, and in which the operating temperature is 65 to 75° C., an operation error due to self-heating can be sufficiently prevented from occurring, and excellent thermal stability can be guaranteed because of the sufficiently reduced amount of In.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An alloy type thermal fuse wherein said fuse comprises a fuse element of an alloy composition of 37 to 43% In, 10 to 18% Sn, and balance Bi.

2. An alloy type thermal fuse according to claim 1, wherein said alloy composition contains inevitable impurities.

3. An alloy type thermal fuse according to claim 1, wherein an operating temperature is 65 to 75° C.

4. A fuse element constituting an alloy type thermal fuse wherein said fuse element has an alloy composition of 37 to 43% In, 10 to 18% Sn, and balance Bi.

5. A fuse element according to claim 4, wherein said alloy composition contains inevitable impurities.

6. A fuse element according to claim 4, wherein an operating temperature is 65 to 75° C.

* * * * *